US011364653B1

(12) United States Patent
Voss et al.

(10) Patent No.: US 11,364,653 B1
(45) Date of Patent: Jun. 21, 2022

(54) DEVICE FOR STAINING OR PAINTING PLANKS

(71) Applicant: StainTrac, LLP, Tulsa, OK (US)

(72) Inventors: Duane Carl Voss, Inola, OK (US); Clifford Marion Richison, Tulsa, OK (US); Joshua Mikal Burrup, Broken Arrow, OK (US)

(73) Assignee: STAINTRAC, LLP, Tulsa, OK (US)

( * ) Notice: Subject to any disclaimer, the term of this patent is extended or adjusted under 35 U.S.C. 154(b) by 102 days.

(21) Appl. No.: 16/901,615

(22) Filed: Jun. 15, 2020

Related U.S. Application Data

(60) Provisional application No. 62/861,049, filed on Jun. 13, 2019.

(51) Int. Cl.

| | |
|---|---|
| ***B05B 13/02*** | (2006.01) |
| ***B05C 1/08*** | (2006.01) |
| ***B05C 9/04*** | (2006.01) |
| ***B05C 1/02*** | (2006.01) |
| ***B05B 13/04*** | (2006.01) |
| ***B27K 5/02*** | (2006.01) |

(52) U.S. Cl.
CPC ..... *B27K 5/02* (2013.01); *B05B 13/02* (2013.01); *B05B 13/0436* (2013.01); *B05C 1/025* (2013.01); *B05C 1/08* (2013.01); *B05C 1/083* (2013.01); *B05C 9/04* (2013.01)

(58) Field of Classification Search
None
See application file for complete search history.

(56) References Cited

U.S. PATENT DOCUMENTS 2,015,768 A * 10/1935 Thompson ..... B44D 3/225 118/208
2,489,445 A * 11/1949 Benzuly ..... B05B 13/0207 118/305
3,319,601 A * 5/1967 Baker ..... B05C 9/06 118/255

(Continued)

FOREIGN PATENT DOCUMENTS

CN 203540847 4/2014
CN 103623977 12/2015

(Continued)

*Primary Examiner* — Binu Thomas
(74) *Attorney, Agent, or Firm* — James F. Lea, III; Gable Gotwals

(57) ABSTRACT

A device for staining or painting planks has an enclosure and a plank receiver for guiding a plank into the enclosure. At least one pair of vertical rollers are provided for engaging the plank received in the plank receiver. A lever may be positioned to contact the plank upon exit from the plank receiver. A linkage bar is affixed to the lever and to vertical rollers. Moving the lever by insertion of the plank moves the vertical rollers in preparation for receiving a leading edge of the plank. The vertical rollers are mounted on swing arms for facilitating adjustment of a space between the left vertical rollers and the right vertical rollers for accommodating planks of various thicknesses. Vertical sprayers are pivotally mounted and in communication with the swing arms for pivoting with the vertical rollers for maintaining a constant distance between the vertical rollers and the left vertical sprayer.

16 Claims, 5 Drawing Sheets

(56) References Cited

U.S. PATENT DOCUMENTS

| | | | | | |
|---|---|---|---|---|---|
| 4,353,324 | A * | 10/1982 | Schnittker | B05C 9/04 | 118/207 |
| 4,493,857 | A * | 1/1985 | Knigge | B05C 9/04 | 430/271.1 |
| 4,630,407 | A * | 12/1986 | Rhodes | B24B 7/20 | 451/190 |
| 5,368,643 | A | 11/1994 | Kuster | | |
| 6,045,282 | A * | 4/2000 | Begin | B05C 17/0227 | 401/197 |
| 6,174,372 | B1 | 1/2001 | Yoshinaga et al. | | |
| 6,273,976 | B1 * | 8/2001 | Oliver | B29C 63/02 | 118/227 |
| 6,613,147 | B1 * | 9/2003 | Nieto | B05B 14/40 | 118/326 |
| 8,230,804 | B1 * | 7/2012 | Barbieri | B05C 1/08 | 118/222 |
| 2002/0104479 | A1 * | 8/2002 | Ochiai | B05C 9/04 | 118/211 |
| 2015/0165468 | A1 * | 6/2015 | Schiele | B05C 1/08 | 118/58 |

FOREIGN PATENT DOCUMENTS

| | | |
|---|---|---|
| CN | 206373010 | 8/2017 |
| DE | 1949039 | 9/1969 |

* cited by examiner

DEVICE FOR STAINING OR PAINTING PLANKS

CROSS REFERENCE TO RELATED APPLICATIONS

This application claims the priority of U.S. Provisional Patent Application No. 62/861,049 titled "DEVICE FOR PAINTING PLANKS," filed Jun. 13, 2019, the contents of which are hereby incorporated by reference.

FIELD OF THE INVENTION

The invention relates to a device for quickly staining or painting a longitudinal member, such as a fence plank. More particularly, the device of the invention is an enclosure having a plurality of rollers for contacting and painting or staining each side of a plank and having mechanisms to ensure ease of movement of the planks through the device.

BACKGROUND OF THE INVENTION

Staining or painting planks, e.g., for use in fence construction, is repetitive and is time and labor intensive. Additionally, there is a potential for a large amount of paint or stain to be wasted in transition from one plank to another.

It is desirable to automate the staining or painting of planks for efficiency. Additionally, it is desirable to reduce the amount of stain or paint that may be wasted.

SUMMARY OF THE INVENTION

A device for staining or painting planks is described herein. The device includes an enclosure defining a bottom surface. A plank receiver is provided for guiding a plank into the enclosure. A first pair of vertical rollers are provided for engaging the plank received in the plank receiver. A second pair of vertical rollers may also be provided for engaging the plank. A lever is positioned to contact the plank upon exit from the plank receiver. A linkage bar is affixed to the lever. The linkage bar is additionally affixed to one of the first pair of vertical rollers and to one of the second pair of vertical rollers. Movement of the lever, e.g. by the plank when the plank is inserted into the enclosure, moves one of the first pair of vertical rollers and one of the second pair of vertical rollers in preparation for receiving a leading edge of the plank.

A frame is preferably provided for supporting the enclosure. A container is supported by a lower shelf of the frame. A pump is provided for delivering contents from the container into the enclosure. The bottom surface of the enclosure defines a drain orifice for transferring unused stain or paint back to the container.

In a preferred embodiment, the plank receiver has a right side and a left side, wherein the right side and the left side are adjustable with respect to one another for accommodating planks of various thicknesses.

In one embodiment, a first left vertical roller of the first pair of vertical rollers is mounted on a left swing arm and a first right vertical roller of the first pair of vertical rollers is mounted on a right swing arm for facilitating adjustment of a space between the first left vertical roller and the first right vertical roller for accommodating planks of various thicknesses.

A left vertical sprayer is pivotally mounted on and in communication with the left swing arm for pivoting with the first left vertical roller for maintaining a constant distance between the first left vertical roller and the left vertical sprayer. A right vertical sprayer is pivotally mounted on and in communication with the right swing arm for pivoting with the first right vertical roller for maintaining a constant distance between the first right vertical roller and the right vertical sprayer.

At least one horizontal roller is preferably provided in the enclosure. The horizontal roller is adapted for vertical movement in response to the plank for accommodating planks of different heights. A horizontal sprayer is provided adjacent to the horizontal roller. The horizontal sprayer is adapted for moving with the horizontal roller for maintaining a constant distance between the horizontal sprayer and the horizontal roller.

The second left vertical roller of the second pair of vertical rollers is mounted on a second left swing arm and the second right vertical roller of the second pair of vertical rollers is mounted on a second right swing arm for facilitating adjustment of a space between the second left vertical roller and the second right vertical roller for accommodating planks of various thicknesses.

At least one plank receiving platform is provided for supporting the plank upon at least one of entry and exit from the enclosure.

DETAILED DESCRIPTION OF THE PREFERRED EMBODIMENTS

Figure 1:
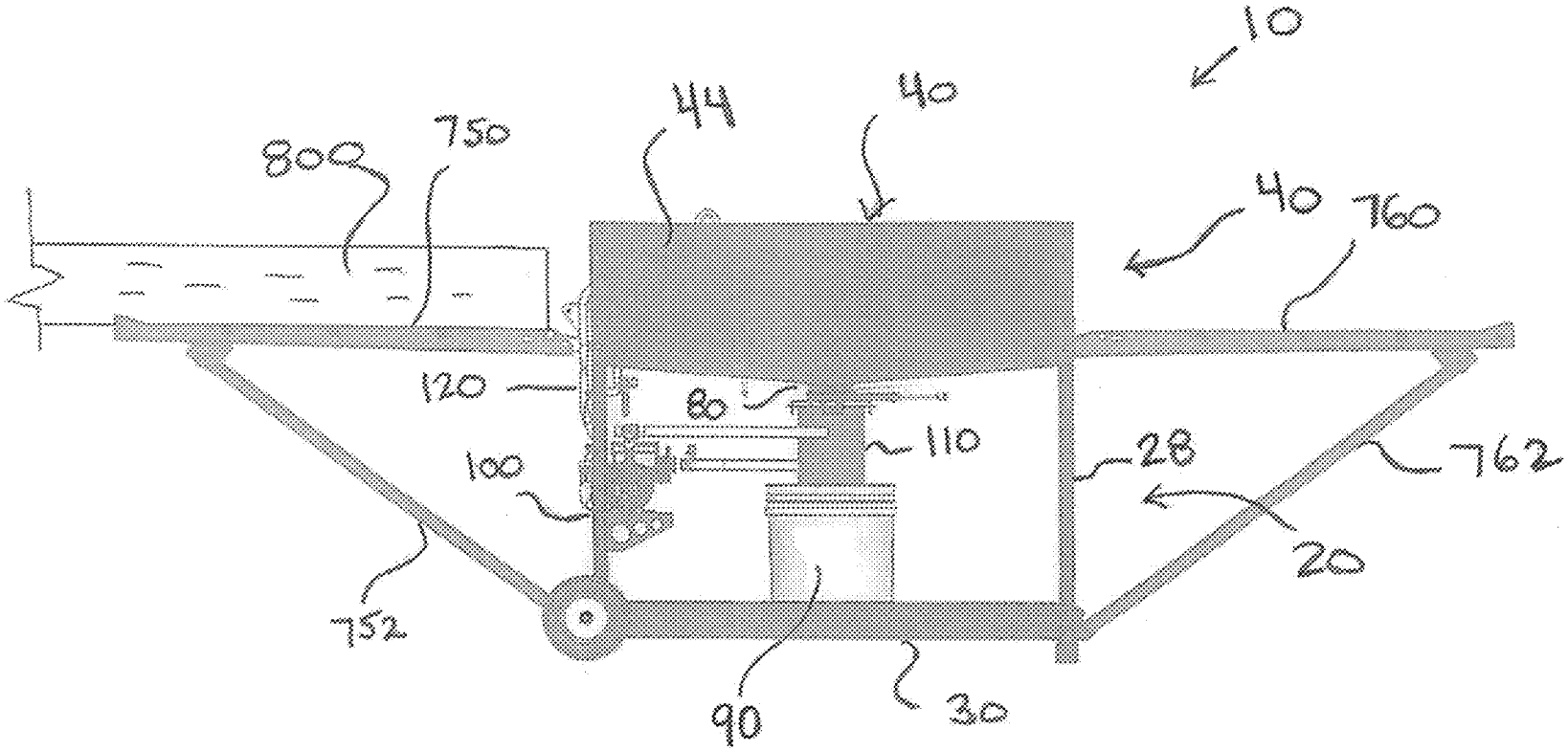
FIG. 1 is a side elevation view of the device of the invention.

Disclosed herein is a device 10 for staining or painting planks. Device 10 includes frame 20 having first left vertical support 22, first right vertical support 24, a second left vertical support, and second right vertical support 28. Lower tray 30 is located between first left vertical support 22, first right vertical support 24, the second left vertical support, and second right vertical support 28.

Left enclosure support 32 extends between first left vertical support 22 and second left vertical support 26. Right enclosure support 34 extends between first right vertical support 24 and the second right vertical support.

Enclosure 40 has left side panel 42 adjacent to left enclosure support 32, right side panel 44 adjacent to right enclosure support 34. Enclosure 40 additionally includes bottom panel 46 having a first end 48 and a second end 50. First end 48 defines a plurality of slots 49. Bottom panel 46 spans between left enclosure support 32 and right enclosure support 34. Right side panel 44 has a top edge, a bottom edge, a first end, a second end, inside surface 60, an outside surface, and a midpoint between the first end and the second end. The first end is connected to first right vertical support 24. The second end is connected to second right vertical support 28.

Left side panel 42 has a top edge, a bottom edge, a first end, a second end, inside surface 74, an outside surface, and a midpoint between the first end and the second end. The first end is connected to first left vertical support 24. The second end is connected to the second left vertical support. Bottom panel 46 defines drain orifice 80.

Container 90 is supported by lower tray 30. Container 90 defines an interior. Pump 100 is preferably located adjacent container 90. Pump 100 is provided for pumping out contents of container 90. Drain pipe 110 is in communication with drain orifice 80. Drain pipe 110 has an upper end and a lower end. The upper end is in communication with drain orifice 80. The lower end is received in container 90 for delivering excess stain or paint from enclosure 40 for re-use.

Vertical pipe 120 is preferably affixed to first right vertical support 24 for delivery of liquids from pump 100 into the enclosure as is known in the art. Piping and tubing extend from vertical pipe 120 to horizontal and vertical sprayers within enclosure 40 as discussed below.

Plank receiver 160 has receiving end 162, a left side defining a support roller pathway, and a right side defining a support roller pathway. Receiving end 162 is preferably flared for receiving a plank. In one embodiment, the left side and the right side of plank receiver 160 may be positioned to be spaced apart at various widths within one of plurality of slots 49 to accommodate planks of different thicknesses.

Figure 5:
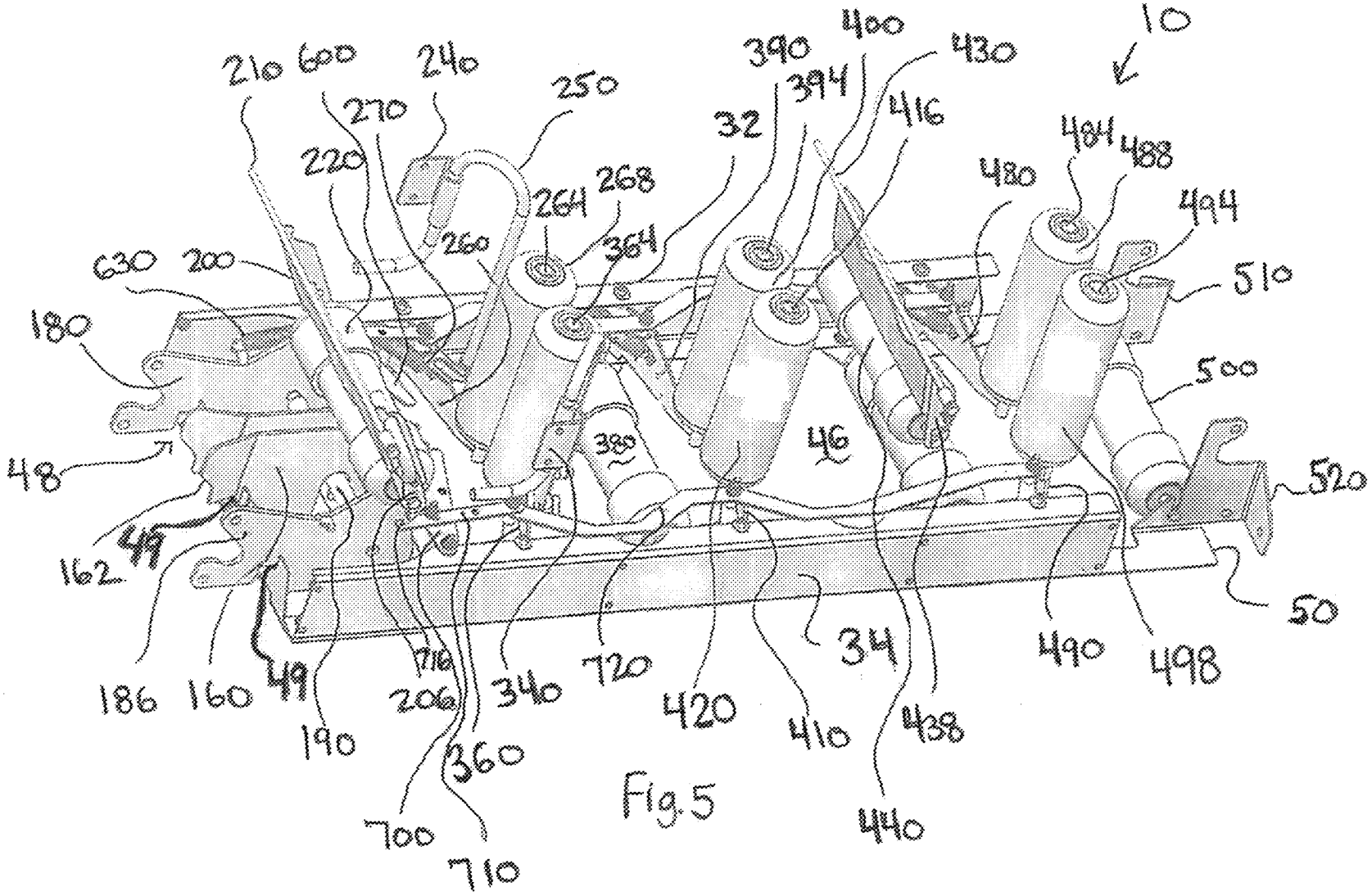
FIG. 5 is an isometric view of a spray nozzle and roller assembly of the device of FIG. 1.

First left fixed support 180 is adjacent to bottom panel 46 proximate first end 48. First left fixed support 180 defines a left support roller orifice. First right fixed support 186 is adjacent to bottom panel 46 proximate first end 48. First right fixed support 186 defines a right support roller orifice. First support roller 190 is rotationally received in the first left support roller orifice and in the first right support roller orifice. First support roller 190 (FIGS. 5, 6) passes through support roller pathways of the left side and the right side of plank receiver 160.

First left slide bar 200 is in slidable communication with first left fixed support 180. First right slide bar 206 is in slidable communication with first right fixed support 186. Sizing plate 210 (FIG. 1) is affixed to first left slide bar 200 and is affixed to first right slide bar 206. Sizing plate 210 is preferably mounted at an angle from vertical. Sizing plate 210 is provided for contacting a plank received in plank receiver 160. Sizing plate 210 is movable upwardly with first left slide bar 200 and first right slide bar 206 to accommodate planks of different widths.

Figure 4:
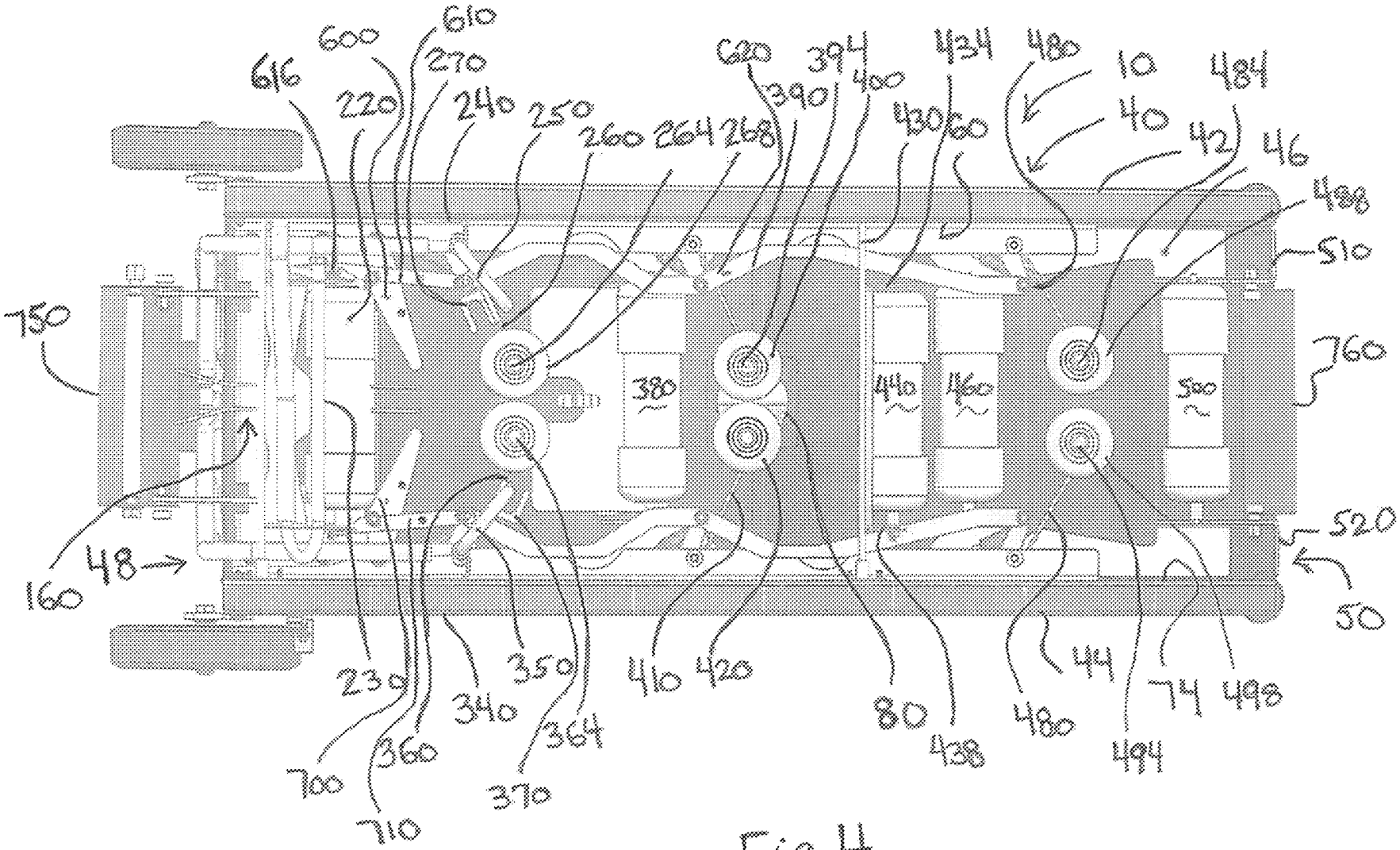
FIG. 4 is an enlarged plan view of the enclosure of the device of FIG. 1.

First upper horizontal roller 220 is affixed to first left slide bar 200 and first right slide bar 206 above plank receiver 160. First upper horizontal roller 220 is for contacting an upper surface of a plank. First horizontal sprayer 230 (best seen in FIG. 4) is affixed to at least one of first left slide bar 200, first right slide bar 206, and sizing plate 210 for maintaining a fixed distance from first upper horizontal roller 220. For smaller planks, sizing plate 210 may not be contacted, i.e., a plank may first contact first upper horizontal roller 220. However, in one embodiment first upper horizontal roller 220, first horizontal sprayer 230 and sizing plate 210 move vertically as a unit.

First left hinge 240 is affixed to inside surface 60 of left side panel 42. First left vertical sprayer 250 is pivotally affixed to first left hinge 240. First left vertical sprayer 250 has a perforated vertical portion and a terminal end. First left roller swing arm 260 is pivotally affixed to left enclosure support 32. First left vertical axle 264 extends upwardly from first left roller swing arm 260. First left vertical roller 268 is rotationally mounted on first left vertical axle 264.

Left position retainer 270 is mounted on first left roller swing arm 260 for receiving the terminal end of first left vertical sprayer 250. Left position retainer 270 is for maintaining the perforated vertical portion at a desired distance from first left vertical roller 268 for delivering stain or paint to first left vertical roller 268.

First right hinge 340 is affixed to inside surface 74 of right side panel 44. First right vertical sprayer 350 is pivotally affixed to first right hinge 340. First right vertical sprayer 350 has a perforated vertical portion and a terminal end. First right roller swing arm 360 is pivotally affixed to right enclosure support 34. First right vertical axle 364 extends upwardly from first right roller swing arm 360. First right vertical roller 368 is rotationally mounted on first right vertical axle 364. Right position retainer 370 is mounted on first right roller swing arm 360 for receiving the terminal end of the first right vertical sprayer. Right position retainer 370 is for maintaining the perforated vertical portion adjacent to first right vertical roller 368 for delivering stain or paint to first right vertical roller 368.

First lower horizontal roller 380 is for contacting a bottom surface of a plank. First lower horizontal roller 380 is rotationally affixed to left enclosure support 32 and right enclosure support 34. First lower horizontal roller 380 is located along the path of plank after first left vertical roller 268 and first right vertical roller 368.

Second left roller swing arm 390 is pivotally affixed to left enclosure support 32 after first lower horizontal roller 380. Second left vertical axle 394 extends upwardly from second left roller swing arm 390. Second left vertical roller 400 is rotationally mounted on second left vertical axle 394. Second right roller swing arm 410 is pivotally affixed to right enclosure support 34. Second right vertical axle 416 extends upwardly from second right roller swing arm 410. Second right vertical roller 420 is rotationally mounted on second right vertical axle 416.

Horizontal support rod 430 is affixed to left side panel 42 and right side panel 44 after second left vertical roller 400 and second right vertical roller 420. Left hanger 434 is affixed to horizontal support rod 430. Right hanger 438 is affixed to horizontal support rod 430. Second upper horizontal roller 440 is rotationally affixed to right hanger 434 and to left hanger 438 for contacting an upper surface of a plank. Second lower horizontal roller 460 is rotationally affixed to left enclosure support 32 and right enclosure support 34 after second upper horizontal roller 40 for contacting a lower surface of a plank.

Third left roller swing arm 480 is pivotally affixed to left enclosure support 32 after second lower horizontal roller 460. Third left vertical axle 484 extends upwardly from third left roller swing arm 480. Third left roller 488 is rotationally mounted on third left vertical axle 484. Third right roller swing arm 490 is pivotally affixed to right enclosure support 34 after second lower horizontal roller 460. Third right vertical axle 494 extends upwardly from third right roller swing arm 490. Third right vertical roller 498 is rotationally mounted on third right vertical axle 494.

Third lower horizontal roller 500 is affixed to left end bracket 510 and to right end bracket 520 proximate to second end 58 of bottom panel 46.

Left lever 600 is pivotally affixed to left enclosure support 32. Left lever 600 extends into a path of a plank proximate to plank receiver 160. Left spring link 610 has a first end and a second end. The first end defines spring tab 616. Left spring link 610 is affixed to left lever 600.

Left linkage bar 620 has a first end and a second end. The first end is affixed to the second end of left spring link 610. Left linkage bar 620 is in communication with first left roller swing arm 260, second left roller swing arm 390, and third left roller swing arm 480 such that, when said left lever 600 is displaced by a plank, left spring link 610 and left linkage bar 620 are longitudinally translated, thereby moving first left vertical roller 268 away from first right vertical roller 368, moving said second left vertical roller 400 away from second right vertical roller 420 and moving third left vertical roller 488 away from third right vertical roller 498. Left spring 630 has a first end and a second end. The first end is affixed to first left fixed support 180. The second end is affixed to spring tab 616 of left spring link 610.

Right lever 700 is attached to right enclosure support 34. Right lever 700 extends into a path of a plank proximate to plank receiver 160. Right spring link 710 has a first end and a second end. The first end defines spring tab 716. Right spring link 710 is affixed to right lever 700.

Right linkage bar 720 has a first end and a second end. The first end is affixed to the second end of right spring link 710. Right linkage bar 720 is in communication with first right roller swing arm 360, second right roller swing arm 410, and third right roller swing arm 490 such that, when right lever 700 is displaced by a plank, right spring link 710 and right linkage bar 720 are longitudinally translated, thereby moving first right vertical roller 368 away from first left vertical roller 268, moving second right vertical roller 420 away from second left vertical roller 400, and moving third right vertical roller 498 away from third left vertical roller 488. A Right spring having a first end and second end may be provided. The first end is affixed to first right fixed support 186. The second end is affixed to spring tab 716 of right spring link 710.

Figure 2:
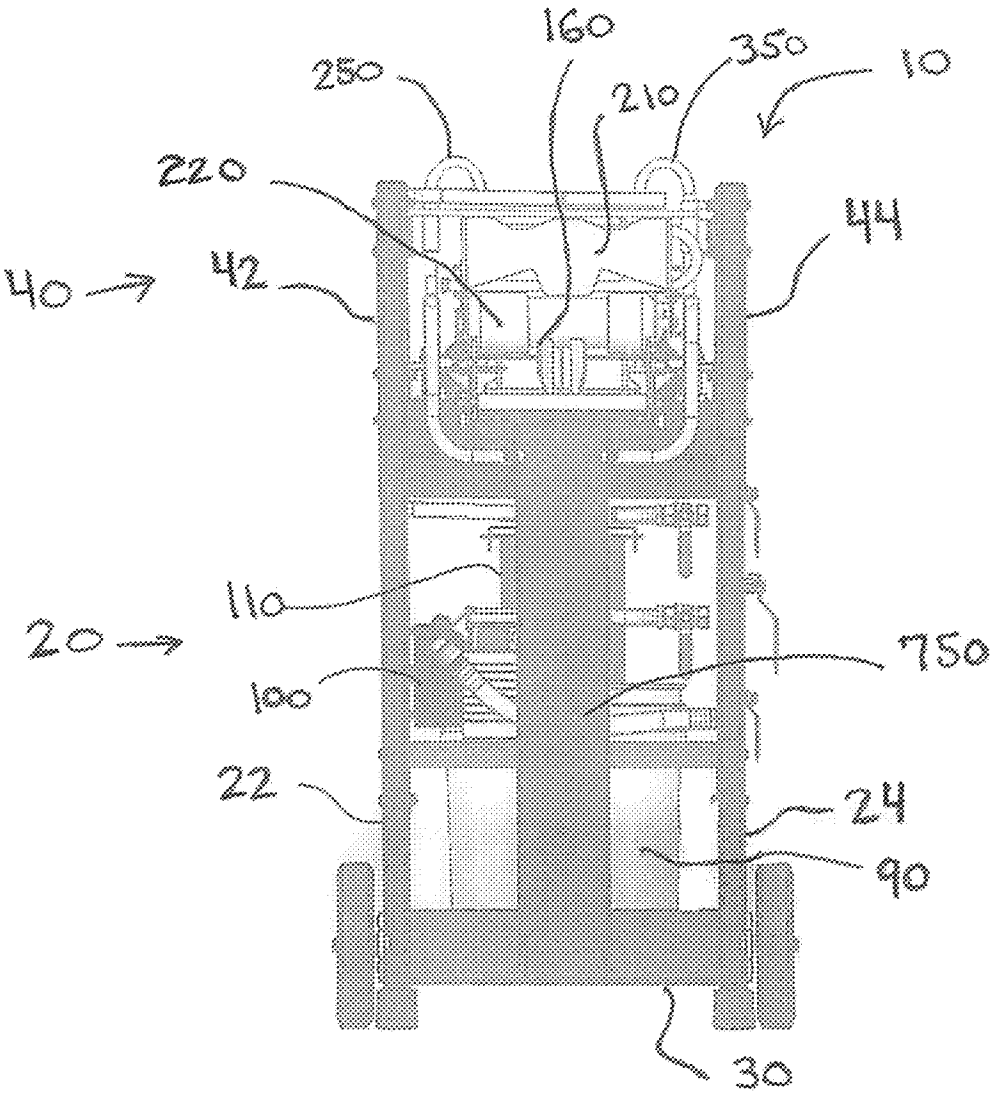
FIG. 2 is an end elevation view of the device of FIG. 1.
Figure 3:
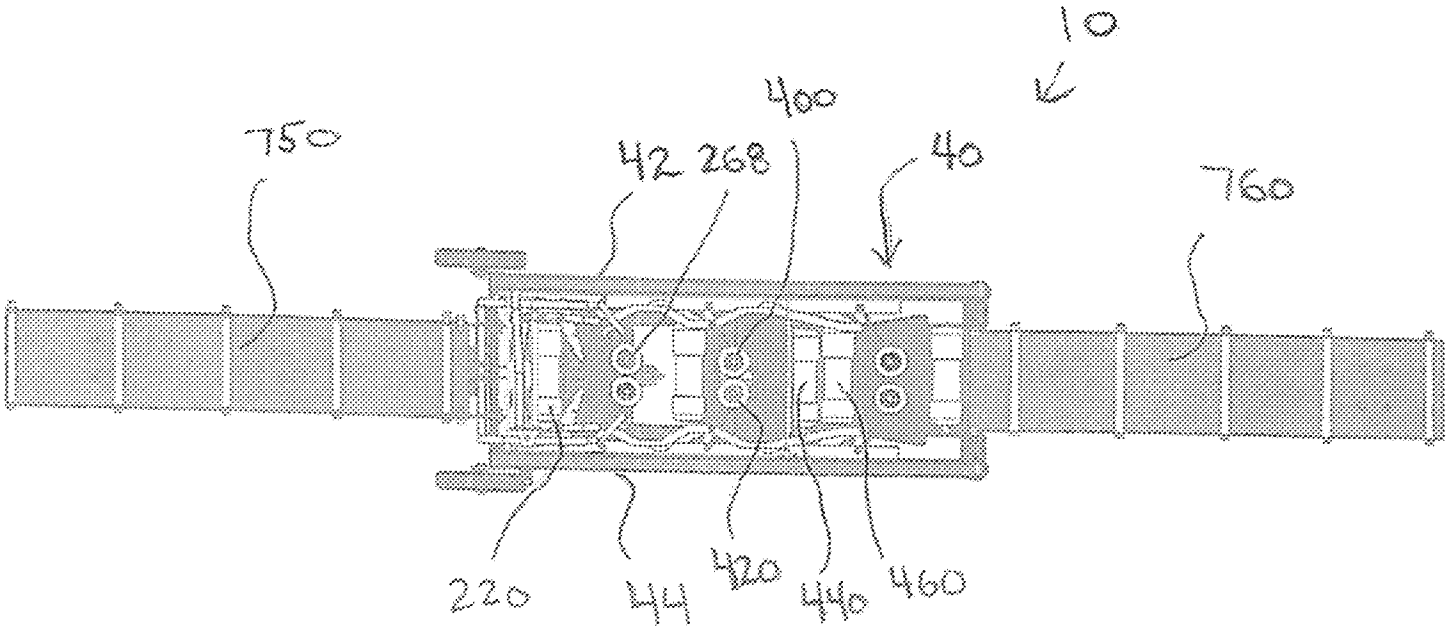
FIG. 3 is a plan view of the device of FIG. 1.

A first plank receiving platform 750 is preferably pivotally received on first left fixed support 180 and first right fixed support 186 and first left fixed support. Platform support 752 is provided to maintain first plank receiving platform 750 in a horizontal position for receiving planks (FIGS. 1 and 3). First plank receiving platform 750 preferably may be positioned in a vertical orientation (FIGS. 2 and 4) for storage.

A second plank receiving platform 760 is pivotally affixed to left end bracket 510 and right end bracket 540. Platform support 762 is provided to maintain second plank receiving platform 760 in a horizontal position for receiving planks after passing through enclosure 40 (FIGS. 1 and 3). Second plank receiving platform 760 preferably may be positioned in a vertical orientation (FIGS. 2 and 4) for storage.

Device 10 is for applying stain or paint to a plank. A plank has a leading end, a trailing end, a left side, right side, top side, and bottom side. Plank 800 is received on first plank receiving platform 750 where plank 800 may be fed into in plank receiver 164. After passing through plank receiver 164, plank 800 is supported on support roller 190. Plank 800 may then be advanced until making contact with first upper horizontal roller 220, whereupon first upper horizontal roller 220 and first horizontal sprayer 230 are lifted, if necessary, to accommodate a height of plank 800. Stain or paint is delivered from first horizontal sprayer 230 to first upper horizontal roller 220 and rolled onto plank 800.

The leading end of plank 800 is further advanced until making contact with left lever 600 and right lever 700, whereupon levers 600, 700 are displaced by plank 800. Displacement of levers 600 and 700 longitudinally displaces left linkage bar 620 and right linkage bar 720, thereby simultaneously separating first left vertical roller 268 and first right vertical roller 368, separating second left vertical roller 400 from second right vertical roller 420, and separating third left vertical roller 488 from third right vertical roller 498 by a desired amount for contacting left side 806 and right side 808 of plank 800 as it passes between the vertical rollers.

Stain or paint is delivered to first left vertical roller 268 through perforated vertical portion of first left vertical sprayer 250. Stain or paint is delivered to first right vertical roller 368 through perforated vertical portion of first right vertical sprayer 350. First left vertical roller 268 and first right vertical roller 368 apply stain or paint to the sides of plank 800 and the plank passes between the rollers. Plank 800 then passes over first lower horizontal roller 380 and then between second left vertical roller 400 and second right vertical roller 420. Upon making contact with second upper horizontal roller 440, the leading edge of plank 800 pivots second upper horizontal roller 440 forward and upwards to accommodate a height of plank 800, if necessary. The leading edge of plank 800 then passes through third left vertical roller 488 and third right vertical roller 498, and over third lower horizontal roller 500 whereupon the plank is received on second plank receiving platform 760.

Although particular embodiments have been described herein, it will be appreciated that the invention is not limited thereto and that many modifications and additions thereto may be made within the scope of the invention. For example, various combinations of the features of the following dependent claims can be made with the features of the independent claims without departing from the scope of the present invention.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A device for staining or painting planks comprising:
- an enclosure defining a bottom surface;
- a plank receiver for guiding a plank into said enclosure;
- a first pair of vertical rollers for engaging the plank received in said plank receiver;
- a second pair of vertical rollers for engaging the plank;
- a lever positioned to contact the plank upon exit from said plank receiver;

a linkage bar affixed to said lever, said linkage bar affixed to one of said first pair of vertical rollers and to one of said second pair of vertical rollers;

wherein movement of said lever moves said one of said first pair of vertical rollers and one of said second pair of vertical rollers in preparation for receiving a leading edge of the plank.

2. The device according to claim 1 further comprising:

a frame for supporting said enclosure;

a container supported by said frame;

a pump for delivering contents from said container into said enclosure.

3. The device according to claim 2 wherein:

said bottom surface of said enclosure defines a drain orifice for transferring unused stain or paint back to said container.

4. The device according to claim 1 wherein:

said plank receiver has a right side and a left side, said right side and said left side adjustable with respect to one another for accommodating planks of various thicknesses.

5. The device according to claim 1 wherein:

said first pair of vertical rollers comprise a first left vertical roller and first right vertical roller wherein said first left vertical roller is mounted on a left swing arm and said first right vertical roller is mounted on a right swing arm for facilitating adjustment of a space between said first left vertical roller and said first right vertical roller for accommodating planks of various thicknesses;

a left vertical sprayer pivotally mounted and in communication with said left swing arm for pivoting with said first left vertical roller for maintaining a constant distance between said first left vertical roller and said left vertical sprayer;

a right vertical sprayer pivotally mounted and in communication with said right swing arm for pivoting with said first right vertical roller for maintaining a constant distance between said first right vertical roller and said right vertical sprayer.

6. The device according to claim 1 further comprising:

at least one horizontal roller in said enclosure, said at least one horizontal roller adapted for vertical movement in response to the plank for accommodating planks of different heights;

a horizontal sprayer adjacent said at least one horizontal roller, said horizontal sprayer adapted for moving with said horizontal roller for maintaining a constant distance between said horizontal sprayer and said horizontal roller.

7. The device according to claim 1 wherein:

said second pair of vertical rollers comprise a second left vertical roller and second right vertical roller wherein said second left vertical roller is mounted on a second left swing arm and said second right vertical roller is mounted on a second right swing arm for facilitating adjustment of a space between said second left vertical roller and said second right vertical roller for accommodating planks of various thicknesses.

8. The device according to claim 1 further comprising:

at least one plank receiving platform for supporting the plank upon at least one of entry and exit from said enclosure.

9. A device for staining or painting planks comprising:

an enclosure defining a bottom surface, a left side panel extending upwardly from said bottom surface and a right side panel extending upwardly from said bottom surface;

a plank receiver having a vertical left side member and a vertical right side member for receiving and guiding the plank therebetween and for guiding the plank into said enclosure;

a first pair of vertical rollers between said left side panel and said right side panel, said first pair of vertical rollers comprising a first left vertical roller and first right vertical roller wherein said first left vertical roller is mounted on a left swing arm and said first right vertical roller is mounted on a right swing arm for facilitating adjustment of a space between said first left vertical roller and said first right vertical roller for accommodating planks of various thicknesses;

a left vertical sprayer pivotally mounted and in communication with said left swing arm for pivoting with said first left vertical roller for maintaining a constant distance between said first left vertical roller and said left vertical sprayer;

a right vertical sprayer pivotally mounted and in communication with said right swing arm for pivoting with said first right vertical roller for maintaining a constant distance between said first right vertical roller and said right vertical sprayer.

10. The device according to claim 9 further comprising:

a frame for supporting said enclosure;

a container supported by said frame;

a pump for delivering contents from said container into said enclosure.

11. The device according to claim 10 wherein:

said bottom surface of said enclosure defines a drain orifice for transferring unused stain or paint back to said container.

12. The device according to claim 9 wherein:

said plank receiver has a right side and a left side, said right side and said left side adjustable with respect to one another for accommodating planks of various thicknesses.

13. The device according to claim 9 further comprising:

at least one horizontal roller in said enclosure, said horizontal roller adapted for vertical movement in response to the plank for accommodating planks of different heights;

a horizontal sprayer adjacent said horizontal roller, said horizontal sprayer adapted for moving with said horizontal roller for maintaining a constant distance between said horizontal sprayer and said horizontal roller.

14. The device according to claim 9 further comprising:

a second pair of vertical rollers comprising a second left vertical roller and a second right vertical roller wherein said second left vertical roller is mounted on a second left swing arm and said second right vertical roller is mounted on a second right swing arm for facilitating adjustment of a space between said second left vertical roller and said second right vertical roller for accommodating planks of various thicknesses.

15. A device for staining or painting planks comprising:

an enclosure defining a bottom surface;

a plank receiver for guiding a plank into said enclosure;

a first pair of vertical rollers comprising a first left vertical roller and first right vertical roller wherein said first left vertical roller is mounted on a left swing arm and said first right vertical roller is mounted on a right swing arm for facilitating adjustment of a space between said first left vertical roller and said first right vertical roller for accommodating planks of various thicknesses;

a left vertical sprayer pivotally mounted and in communication with said left swing arm for pivoting with said first left vertical roller for maintaining a constant distance between said first left vertical roller and said left vertical sprayer;

a right vertical sprayer pivotally mounted and in communication with said right swing arm for pivoting with said first right vertical roller for maintaining a constant distance between said first right vertical roller and said right vertical sprayer;

a second pair of vertical rollers comprising a second left vertical roller and a second right vertical roller wherein said second left vertical roller is mounted on a second left swing arm and said second right vertical roller is mounted on a second right swing arm for facilitating adjustment of a space between said second left vertical roller and said second right vertical roller for accommodating planks of various thicknesses;

a lever positioned to contact the plank upon exit from said plank receiver;

a linkage bar affixed to said lever, said linkage bar affixed to one of said first pair of vertical rollers and to one of said second pair of vertical rollers;

wherein movement of said lever moves one of said first pair of vertical rollers and one of said second pair of vertical rollers for preparing to receive a leading edge of the plank.

16. The device according to claim 9 further comprising:

at least one plank receiving platform for supporting the plank upon at least one of entry and exit from said enclosure.

* * * * *